United States Patent [19]

Young

[11] 3,943,155

[45] Mar. 9, 1976

[54] SIMULTANEOUS REFINING AND DEWAXING OF CRUDE VEGETABLE OIL

[75] Inventor: Herbert Thomas Young, Cincinnati, Ohio

[73] Assignee: The Procter & Gamble Company, Cincinnati, Ohio

[22] Filed: May 13, 1974

[21] Appl. No.: 469,267

[52] U.S. Cl. ..... 260/424; 260/425

[51] Int. Cl.[2] ..... C11B 3/04; C11B 3/06

[58] Field of Search ..... 260/424, 425

[56] References Cited

UNITED STATES PATENTS

| | | | |
|---|---|---|---|
| 2,510,379 | 6/1950 | Christensen | 260/424 |
| 2,702,813 | 2/1955 | Sullivan | 260/425 |
| 2,752,378 | 6/1956 | Julian et al. | 260/425 |
| 2,878,274 | 3/1959 | Van Akkeren et al. | 260/425 |
| 3,549,386 | 12/1970 | Menzies et al. | 260/428 |

*Primary Examiner*—Patrick P. Garvin
*Assistant Examiner*—P. E. Konopka

[57] ABSTRACT

A process for refining and dewaxing crude vegetable oils using only one separation step which removes both the hydrophilic and waxy components from the crude oil. An alkali refining/dewaxing treatment is employed on crude oil at a temperature of from about 15°F to about 45°F.

11 Claims, No Drawings

SIMULTANEOUS REFINING AND DEWAXING OF CRUDE VEGETABLE OIL

BACKGROUND OF THE INVENTION

Crude vegetable glyceride oils, as they are obtained from their natural sources by conventional extraction methods, normally contain various non-glyceride impurities. These nonglyceride substances include gross material from the source of fat, such as xanthophyll or chlorophyll; products obtained by the breakdown of the glyceride during treatment, such as free fatty acids; and other derivatives of the glycerides, such as phosphatides and sterols. In addition, many vegetable oils normally contain natural waxes from the crushing of the coat of the oilseeds employed. Some of these above-mentioned impurities are desirable in that they help to protect the oil from oxidation or other adverse processes, but by far the greater amount of these substances must be removed during processing for edible purposes because they are deleterious to the appearance, taste, keeping qualities, and other properties of the oil. Refining and winterizing or dewaxing operations have, thus, become commonly employed to effect the removal of these impurities.

The removal of gross impurities, gummy or mucilaginous material, and the free fatty acids from the glyceride oil is commonly referred to as "refining" and as herein used the term excludes "bleaching" (color removal) and odor removal. In a typical refining operation, undesirable impurities are preferentially combined with a refining agent to form hydrophilic components. These are subsequently removed from the oil by a separation of aqueous and oil phases. Known methods of refining include contacting the glyceride oil with strong or dilute alkaline materials followed by separation of impurities, by liquid-liquid extraction of impurities from the glyceride oils, by steam distillation, and by contacting the glyceride oils with acids. Each of these methods is said to have its advantages for use in refining oils of one type or another for a certain ultimate utility by removing to a greater or lesser extent the hydrophilic component of the oils.

However, these known refining methods do not remove all of the impurities from the vegetable oil, and in particular, waxy components tend to remain in such oils. For example, if the refined vegetable oils is cooled to a temperature of about 40°F, the higher melting triglycerides and any vegetable waxes (linear esters) present will crystallize and either impart a cloudy appearance to the oil or settle out as a crystalline precipitate. When the oil is again raised to room temperature, the crystallized waxes may redissolve in the oil. Thus, the oil at room temperature may or may not regain its clarity depending upon the amount of the respective impurities contained in it. Thus, without further processing, any such vegetable oil containing these higher melting triglycerides or vegetable waxes is not suitable for certain purposes where the clarity of the oil at low temperatures is important.

For example, oils which are suitable for salad oil use frequently are stored in refrigerators. The prolonged cooling of such oils to temperatures normally encountered in refrigerators, such as from about 30°F to about 50°F, requires a product which retains its clarity if it is to be desirable to the consumer.

The term "winterizing" has variously been applied to both the process of removing the higher melting triglycerides and the process of removing the naturally occurring vegetable waxes. To avoid this ambiguity in the term's usage, the term "winterization" will herein be used to refer only to the removal of the higher triglycerides from the oil and the term "dewaxing" will herein be employed to refer to the removal of naturally occurring vegetable waxes.

The ultimate objective of a refining or dewaxing operation is to remove every undesirable impurity completely, while at the same time maintaining intact all of the desirable glyceride oil. The particular process used with a given oil is determined by the foregoing considerations of maximum impurity removal with the minimum of glyceride oil loss. Since a good part of the refining cost arises from losses of glyceride oil, much work has been done to increase the efficiency of refining and dewaxing operations, and many processes have been developed for this purpose. The majority of the refining processes developed employ temperatures of at least room temperature and often higher to obtain a complete removal of the hydrophilic impurities and to minimize oil losses. These processes, of course, do not accomplish removal of the waxy component, which is inseparable from the glyceride component at these higher temperatures. Thus, a separate low-temperature dewaxing step is necessary to remove the waxy component. Since there are oil losses inherent in the separation steps which usually follow the refining and dewaxing operations, methods which embody multiple separation steps tend to be uneconomic. Low-temperature refining methods have been attempted to simultaneously remove the hydrophilic and waxy components from the crude oil; however, the methods developed thus far have not been entirely satisfactory. At low temperatures, a virtually inseparable emulsion tends to be formed from a vegetable oil and an aqueous refining agent. This results either in extraordinarily high oil refining losses or an incomplete removal of the impurities, the latter which results in a cloudy oil at low temperatures.

Today, much of the glyceride oil is refined in a continuous process. This process involves the steps of bringing the oil and alkali to an elevated temperature, mixing these two materials, adjusting the temperature, if necessary, providing a sufficient hold time, subjecting the mixture to degasification or other steps as are necessary, and continuously separating the refined glyceride oil from the impurities by centrifugation. Thereafter, if dewaxing is necessary, the refined oil is cooled to a low temperature to crystallize the waxy components. These are then removed by either a slow filtration or a second aqueous separation step performed on the cooled oil. Cumulative oil losses result from the individual separation steps employed.

SUMMARY OF THE INVENTION

According to the process of the present invention, crude vegetable oils are simultaneously refined and dewaxed by cooling the vegetable oils to a temperature sufficient to crystallize the vegetable waxes and separate them from the desirable glyceride oils. The cooled oil is gently agitated and a pre-chilled aqueous alkali refining agent is then added and admixed with the oil. The emulsion thus formed between the oil and the aqueous alkali solution is not easily broken at the low temperature conditions of the process; therefore a catalytic amount of phosphoric acid is added as a de-emulsifier. After further mixing, the mixture is centrifuged into an oil phase and a water-soluble soapstock or "foots" phase. Thereafter, the refined and dewaxed oil can be water-washed, dried, bleached, and deodorized by conventional techniques to yield a vegetable oil with excellent chill test results.

DETAILED DESCRIPTION OF THE INVENTION

This invention relates to a process for simultaneously refining and dewaxing a crude vegetable oil by successively chilling, admixing with an alkali refining agent, admixing with a catalytic amount of phosphoric acid as an emulsion breaker, and separating an aqueous phase from an oil phase.

The process of this invention has been developed primarily to process those oils which contain waxes which precipitate at refrigerator temperatures. The most common of such oils are sunflower, safflower and corn oils, although other vegetable oils encounter similar problems and may be advantageously processed in accordance with the present invention.

In accordance with the present invention, crude vegetable oil is chilled using a conventional chilling apparatus (e.g., a heat exchanger) to a temperature of from about 15° to about 45°F, and most desirably from about 20°F to about 30°F. Neither the incoming temperature of the vegetable oil nor the exact means for cooling the oil are critical to this process and a variety of heat exchangers known to the art may be advantageously employed. The cooled oil is fed into a "crystallizer tank" and gently agitated to promote crystallization of vegetable waxes contained in the oil. A "crystallizer tank," as used herein and generally in the art, refers to any vessel in which fluids, such as oil and/or refining agent mixtures can be contained, mixed, tempered or allowed to crystallize, and having means for agitation and discharge of the contained fluids. While being agitated in the crystallizer tank, the oil should be maintained at a temperature of about 15° to about 45°F. Although the incoming temperature of the oil is not critical to the practice of the present invention, it is desirable that the incoming oil be at a temperature of at least about 60°F as the rapid cooling of the oil in the heat exchanger before introduction into the crystallizer tank and the maintenance of the oil at this low temperature in the crystallizer tank with agitation promotes rapid crystallization of the impurities contained in the oil. After introduction of the crude oil into the crystallizer tank, the agitation may be continued for a period of time to allow for further crystallization of the contained waxes. However, this additional agitation is not necessary for the attainment of a fully dewaxed oil if the initial feed rate of the crude oil is such that a mean mixing time of at least about 15 minutes and preferably from about 20 minutes to about 40 minutes for the total amount of crude oil results during the feeding operation.

Upon completion of chilling and agitation of the oil, a dilute aqueous alkali refining agent solution is added in an amount sufficient to completely remove the hydrophilic and waxy components from the oil. The alkali refining agent neutralizes the free fatty acid content of the oil by forming a soapstock of "foots" phase which is insoluble in the oil phase and soluble in the aqueous phase of the mixture. The waxy components of the oil are also somewhat hydrophilic in that the waxy components exhibit a polar nature and concentrate on the surface interface between the oil and aqueous phases of the mixture. Upon separation of the two phases, the waxy components remain associated with the aqueous solution and are separated from the oil phase.

It has been found that to secure adequate refining and dewaxing completeness while obtaining the lowest refining loss as possible with this invention, it is necessary that there be added at least one alkali equivalent for each mole of free fatty acid present in the crude oil, and preferably, in the range of 3 to 5 equivalents. As those skilled in the art will appreciate, the free fatty acid content for a particular batch of oil is readily determined by a titration with a standard alkali. So long as the quantity of alkali equivalents present is sufficient to neutralize all the free fatty acids present in the oil, the upper limit of alkali usage is set only by economic considerations and the volume of alkali solution which one wishes to introduce into the crude oil during the refining operation. In the practice of the present invention, it has been found that the total alkali solution should comprise from about 15 to about 50 percent by weight of the oil, and preferably from about 20 to about 40 percent by weight of the oil.

Alkali solutions that have been found acceptable for purposes of this invention include, but are not limited to sodium hydroxide, sodium bicarbonate, calcium hydroxide, potassium hydroxide, magnesium hydroxide, ammonia, and some organic alkalies. When sodium hydroxide is used as the alkali material, it should be mixed to a concentration within the range from about 1.0 to about 3.0 percent by weight of lye in the water. This concentration range is important as above 3.0 percent the refining losses become excessive, and below 1.0 percent, the oil is not refined. When other alkali agents are used, correspondingly different concentration ranges are employed to obtain the proper alkali equivalents in the amount of alkali solution used.

In the practice of the present invention, the aqueous alkali refining solution should be pre-chilled to maintain the low temperature of the oil during processing. The addition of an aqueous alkali refining agent to the crude oil produces a slightly exothermic reaction. Thus, the temperature of the refining agent must be sufficiently low to insure that the oil-refining agent mixture does not exceed about 45°F after admixing.

After the addition of the alkali refining agent, the oil-aqueous solution is admixed for a minimum of about 15 minutes. The agitation must be strong enough to uniformly disperse and promote complete admixing of the alkali refining solution without, at the same time, forming an inseparable emulsion with the oil phase. Agitation may be provided by any suitable means, although rotary mixers operating to provide low shear are preferred in the practice of the present invention. If high shear mixing is employed, there is a tendency for the alkali solution and the oil to form a virtually inseparable emulsion making further separation difficult and refining losses excessively high. If the mixing means employed utilizes a mechanical rotary mixing device, the actual mixer used is not critical as long as the blade size, rotational speed, and container size are combined to give low shear and high circulation. The use of a finger-type paddle impeller is advantageously employed in the practice of the present invention since it gently agitates the oil and promotes thorough admixing with the refining agent without creating any one area of violent agitation, as encountered with a marine-type impeller, or a "dead area" in the container where the oil does not adequately co-mingle with the aqueous refining agent. Also within the scope of the present invention is the use of other mixing means known in the art, such as air or other inert gases bubbled through the mixture to promote admixing.

In accordance with the present invention, a catalytic amount of an aqueous phosphoric acid solution is added to the gently agitating oil-aqueous alkali refining agent solution to act as a de-emulsifier. It is preferred that the phosphoric acid solution have a concentration of from about 20 to about 100 percent by weight of absolute acid for attaining optimal results with the present process, with an especially preferred concentration of from about 20 to about 40 percent of absolute acid. It has been found that merely a minimal amount of phosphoric acid solution is effective in acting as an emulsion breaker for aiding in the separation of the oil phase from the foots phase. This small amount of phosphoric acid has been found to be extremely effective in breaking the oil-water emulsion which would otherwise produce high oil losses, due to the low-temperature refining. Of course, in the practice of the present invention, there is no need for a second separation step since both the hydrophilic and waxy components are removed by the low-temperature alkali treatment. An acceptable range of phosphoric acid is found to be from about 0.05 to about 0.2 percent by weight of the crude oil with a preferred range of from about 0.07 to about 0.15 percent by weight of the crude oil. It has been found that an amount of acid solution in excess of 0.2 percent by weight yields unacceptable refining/dewaxing results. In the practice of the present invention, it is critical that this catalytic amount of phosphoric acid solution be added to the oil after the alkali refining agent is admixed and agitated with the crude oil. When the phosphoric acid is added to the crude oil before the alkali refining agent is introduced, it is found that the hydrophilic and waxy components are not completely removed. These undesirable effects are illustrated in Example II. Also, in the practice of the present invention, it has been found that if phosphate salts such as trisodium phosphate, are substituted for the phosphoric acid solution, incomplete dewaxing is again observed. After the addition of the phosphoric acid solution, the oil-refining agent mixture should again be mixed for a minimum of about 10 minutes and preferably, from about 15–20 minutes to provide time for a thorough admixing with, and intimate contact of, the mixture and phosphoric acid solution.

After the reagents have had adequate time to react with the hydrophilic and waxy components of the oil, the mixture is separated into its two component phases, i.e., the oil and aqueous phases. This is most conveniently accomplished by centrifuging. Any type of centrifuge known in the art which is adequate to separate the refined and dewaxed vegetable oil from the foots phase is satisfactory. The more recent hermetic continuous centrifuges give excellent results in this process and the older bowl- and disc-type centrifuges are also quite satisfactory. A heavy foots phase and the lighter oil phase are formed. The heavy foots phase consists of water, soaps, waxes, and unreacted lye while the light phase contains the vegetable oil. Separation into the layers is very distinct with total oil refining losses being less than 2.5 percent by weight of the glyceride oil. Likewise, the amount of unremoved impurities is low being in the range of less than about 0.1 percent soap and less than about 1.0 percent water in the light oil phase after centrifuging and before further water-washing. These levels are judged to be very satisfactory.

One of the features of the present invention is its suitability in a continuous refining/dewaxing operation. The process steps would be essentially the same as described above, but with the crude oil, alkali refining agent and phosphoric acid being continuously metered into the process at the appropriate places in the operation.

Subsequent to the refining and dewaxing of the oil, its color is reduced by an operation called "bleaching." In a typical bleaching process the refined and dewaxed oil is mixed with adsorbent. This mix is heated, maintained in heated condition for a period of time, and then filtered to separate the spent adsorbent and decolorized oil. Traditionally, much of the bleaching action occurs during the filtering process because of the high concentration of bleach and adsorbent compared to oil which can be present in this process. Any bleaching process known in the art is suitable for the practice of the present invention. For example, a suitable bleaching operation is described in Harris et al., U.S. Pat. No. 3,673,228 (1972) and entitled "Process for Absorbent Bleaching of Edible Oils." After bleaching, the oil is deodorized, usually with steam. Steam deodorization of edible oils is removal, by various kinds of steam contacting, of free fatty acids and volatile odoriferous and flavorous materials which are responsible for any undesirable smell and taste of undeodorized oil. Again, any deodorization process known in the art is suitable for use in the practice of the present invention. A suitable deodorization operation is described in Baker et al., U.S. Pat. No. 3,506,969, and entitled "Continuous High Temperature Steam Deodorization of Edible Oils."

Upon completion of the above-mentioned bleaching and deodorization operation, a finished oil is obtained which has excellent refrigerator clarity over extended periods of time, making it suitable for use as a salad oil.

The following examples are given to illustrate the practice of the present invention. All percentages are expressed in weight percent.

EXAMPLE I 250 pounds of commercially obtained sunflower seed oil at approximately room temperature were passed through a heat exchanger to reduce the temperature thereof to about 25°F. The oil was then fed into an insulated crystallizer tank and gently agitated by means of a finger-type paddle impeller which was continuously operating. The feed time for the oil was approximately one hour, thus resulting in a 30-minute mean hold time while agitating in the crystallizer tank. Thereafter, 65 pounds of an aqueous lye solution, the amount deemed necessary based upon the free fatty acid content, which was pre-chilled to about 35°F, was introduced into the crystallizer tank and agitated with the crude vegetable oil. The concentration of the aqueous lye solution was about 2.0% sodium hydroxide in water. This mixture was agitated for 15 minutes, forming an emulsion, after which 0.25 pound of a 30% phosphoric acid solution was added to the mixture. After further agitation for an additional period of 15 minutes, the mixture was fed to a continuous centrifuge to separate the distinct oil and aqueous lye phases. Immediately before centrifuging, the oil-lye mixture was at a temperature of 40.5°F.

An analysis of the refined and dewaxed sunflower seed oil at this stage revealed a 0.097% soap and 0.56% water entrapment in the oil phase. After the sunflower seed oil was bleached by conventional operations, "chill tests" were performed upon the oil. Chill tests are a means used in the art to measure the clarity of an oil sample held for a period of time at a constant temperature. These tests revealed that at 32°F the oil retained its clarity for 84 hours; at 40°F, 176 hours, and at 50°F, 488 hours. These chill tests show that the refined and dewaxed sunflower seed oil gives excellent chill test results. The oil is suitable for commercial salad oil purposes. Furthermore, the total refining losses were estimated to be no more than 2½ percent based on the weight of the crude vegetable oil.

Substantially equivalent results are obtained when safflower or corn oil is substituted for sunflower oil in the above example.

Substantially similar results are also obtained when sodium bicarbonate, calcium hydroxide, magnesium hydroxide or ammonia is used, on an equivalent basis, as the alkali refining agent in lieu of the sodium hydroxide in the above example.

EXAMPLE II

Two batches of sunflower seed oil were processed for comparison as to their chill test results. Batch A was processed in a manner identically to that given in Example I, and hence was processed in accordance with the process of the present invention. Batch B, on the other hand, was processed with the addition of the aqueous lye solution and the phosphoric acid reversed. That is, after the crude sunflower seed oil had been introduced into the crystallizer tank, 0.25 pound of a 30 percent concentration phosphoric acid solution was added to the crude vegetable oil. After agitating for about 15 minutes, 50 pounds of an aqueous lye refining agent solution identical to that added to Batch A was added to the oil. This mixture was then agitated for an additional 15 minutes, centrifuged and the oil phase bleached similarly to Batch A. Chill tests performed upon the samples thus prepared yield the following results, with the numbers indicating the hours for which the oil retained its clarity.

| Sample | 32°F | 40°F | 50°F |
|---|---|---|---|
| Batch A | 82 | 100 | 100 |
| Batch B | less than 16 | less than 16 | less than 16 |

It can be seen from the above Table that with Batch A the sunflower seed oil processed in accordance with the present invention, provided a refined and dewaxed oil suitable for commercial salad oil use, while the oil processed with the alkali refining agent and the phosphoric acid addition reversed yielded an oil which did not retain its clarity and hence was unacceptable for salad oil purposes. Duplicate runs of the above Example yielded substantially equivalent results.

The above examples demonstrate that if crude vegetable oils are refined and dewaxed in accordance with the process of the present invention, high quality oils suitable for salad oil use are produced. These oils give excellent chill test results and result in lower refining losses than previously possible where separate refining and dewaxing steps were performed upon the crude vegetable oil. While this invention has been described and exemplified in terms of its preferred embodiment, those skilled in the art will appreciate that modifications can be made without departing from the spirit and scope of the present invention.

What is claimed is:

1. A process for simultaneously removing the hydrophilic and waxy components from crude vegetable oil comprising the steps of:

a. gently agitating a crude vegetable oil at a temperature of from about 15°F to about 45°F;

b. contacting the agitated crude vegetable oil with at least one equivalent of aqueous alkali per mole of free fatty acid present in the crude vegetable oil while maintaining the temperature of the mixture of vegetable oil and aqueous alkali in the range of from about 15°F to about 45°F, thereby to form an emulsion of hydrophilic and waxy components;

c. mixing a phosphoric acid solution in an amount of from about 0.05 to about 0.2 percent by weight of said crude vegetable oil with said mixture of vegetable oil and aqueous alkali, thereby to break said emulsion into a two-phase system; and d. separating the oil phase from the aqueous phase of said two-phase system.

2. The process of claim 1 wherein said crude vegetable oil is reduced to a temperature of from about 20°F to about 30°F.

3. The process of claim 1 wherein the aqueous alkali solution is sodium hydroxide.

4. The process of claim 3 wherein the aqueous alkali solution has a concentration in water of from about 1.0 to about 3.0 percent by weight of sodium hydroxide.

5. The process of claim 1 wherein the aqueous alkali solution comprises of from about 15 to about 50 percent by weight of the vegetable oil.

6. The process of claim 5 wherein the aqueous alkali solution comprises of from about 20 to about 40 percent by weight of the vegetable oil.

7. The process of claim 1 wherein sufficient aqueous alkali solution is added to the crude vegetable oil such that there is from about 3 alkali equivalents to about 5 alkali equivalents for each mole of free fatty acid present in said crude vegetable oil.

8. The process of claim 1 wherein the phosphoric acid solution is in a concentration of from about 20 to about 100 percent by weight of the absolute acid.

9. The process of claim 1 wherein the phosphoric acid solution is in a concentration of from about 20 to about 40 percent by weight of absolute acid.

10. The process of claim 1 wherein said phosphoric acid solution is added in an amount of from about 0.05 to about 0.15 percent by weight of the crude vegetable oil.

11. The process of claim 1 wherein said phosphoric acid solution is added in an amount of about 0.10 percent by weight of the crude vegetable oil.

* * * * *